US007599636B2

(12) United States Patent
Kaji et al.

(10) Patent No.: US 7,599,636 B2
(45) Date of Patent: Oct. 6, 2009

(54) FIXING APPARATUS WITH CURRENT CONTROL TO HEATER

(75) Inventors: Hajime Kaji, Abiko (JP); Toshifumi Kakutani, Toride (JP); Satoru Ishikawa, Ryugasaki (JP); Kazunori Miyake, Toride (JP); Satoru Kanno, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/848,316

(22) Filed: Aug. 31, 2007

(65) Prior Publication Data

US 2008/0008488 A1 Jan. 10, 2008

Related U.S. Application Data

(62) Division of application No. 11/215,972, filed on Sep. 1, 2005, now Pat. No. 7,321,738.

(30) Foreign Application Priority Data

Sep. 6, 2004 (JP) ..... 2004-258712
Nov. 22, 2004 (JP) ..... 2004-337701

(51) Int. Cl.
*G03G 15/20* (2006.01)

(52) U.S. Cl. ..... 399/69; 399/70; 399/328; 219/486

(58) Field of Classification Search ..... 399/67, 399/69, 70, 328; 219/216, 248
See application file for complete search history.

(56) References Cited

U.S. PATENT DOCUMENTS 5,486,903 A 1/1996 Kanno et al.
5,512,993 A 4/1996 Endo et al. ..... 355/285
5,669,039 A 9/1997 Ohtsuka et al.
5,756,969 A 5/1998 Machino et al. ..... 219/497
5,994,671 A 11/1999 Suzuki et al.

(Continued)

FOREIGN PATENT DOCUMENTS

EP 0 797 130 A2 9/1997

(Continued)

OTHER PUBLICATIONS

European Search Report and Office Action, issued by the European Patent Office, on Jan. 4, 2008, in European Application No. 05018939.8.

*Primary Examiner*—David M Gray
*Assistant Examiner*—Laura K Roth
(74) *Attorney, Agent, or Firm*—Fitzpatrick, Cella, Harper & Scinto

(57) ABSTRACT

A fixing apparatus has first and second heating members and a current control unit which controls a number of waves and each of a first AC current to the first heating member and a second AC current to the second heating member in a positive-negative symmetrical pattern by a unit of predetermined number of half-waves. Regardless of a duty ratio of the first heating member and the second heating member, when the current control unit controls a number of waves so that the second AC current is larger than the first AC current in the first duty ratio, the current control unit controls the number of waves so that the first AC current is larger than the second AC current in a second duty ratio adjacent to the first duty ratio.

5 Claims, 11 Drawing Sheets

U.S. PATENT DOCUMENTS

| | | | |
|---|---|---|---|
| 6,385,406 | B1 | 5/2002 | Funamizu et al. |
| 6,519,426 | B2 | 2/2003 | Goto et al. |
| 6,701,117 | B2 | 3/2004 | Kaji |
| 2006/0051118 | A1 | 3/2006 | Kaji et al. |

FOREIGN PATENT DOCUMENTS

| | | |
|---|---|---|
| JP | 9-258598 | 10/1997 |
| JP | 11-339930 | 12/1999 |
| JP | 2004-138839 | 5/2004 |
| WO | WO 2005/064419 | 7/2005 |

FIG. 6

| ON/OFF RATIO | HEATING MEMBER | ON/OFF TABLE IN HALF WAVE UNIT (1: ON 2: OFF) | | | | | | | | | | | | | | | | | | | | |
|---|---|---|---|---|---|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | 15 | 16 | 17 | 18 | 19 | 20 | |
| 0.0% | HEATING MEMBER 403 | 0 | 0 | 0 | 0 | 0 | 0 | 0 | 0 | 0 | 0 | 0 | 0 | 0 | 0 | 0 | 0 | 0 | 0 | 0 | 0 | 0 |
| | HEATING MEMBER 404 | 0 | 0 | 0 | 0 | 0 | 0 | 0 | 0 | 0 | 0 | 0 | 0 | 0 | 0 | 0 | 0 | 0 | 0 | 0 | 0 | 0 |
| 5.0% | HEATING MEMBER 403 | 0 | 0 | 0 | 0 | 0 | 0 | 0 | 0 | 0 | 0 | 0 | 0 | 0 | 0 | 0 | 0 | 0 | 0 | 0 | 0 | 0 |
| | HEATING MEMBER 404 | 0 | 0 | 1 | 0 | 0 | 0 | 0 | 0 | 0 | 0 | 0 | 0 | 0 | 0 | 0 | 0 | 0 | 1 | 0 | 0 | 2 |
| 10.0% | HEATING MEMBER 403 | 0 | 0 | 0 | 0 | 1 | 0 | 0 | 0 | 0 | 0 | 0 | 0 | 0 | 0 | 0 | 0 | 0 | 0 | 0 | 1 | 2 |
| | HEATING MEMBER 404 | 0 | 0 | 0 | 0 | 0 | 0 | 1 | 0 | 0 | 0 | 0 | 1 | 0 | 0 | 0 | 0 | 0 | 0 | 0 | 0 | 2 |
| 15.0% | HEATING MEMBER 403 | 0 | 1 | 0 | 0 | 0 | 0 | 0 | 0 | 1 | 0 | 0 | 1 | 0 | 0 | 0 | 0 | 0 | 0 | 1 | 0 | 4 |
| | HEATING MEMBER 404 | 0 | 0 | 0 | 0 | 0 | 0 | 1 | 0 | 0 | 0 | 0 | 0 | 0 | 0 | 0 | 1 | 0 | 0 | 0 | 0 | 2 |
| 20.0% | HEATING MEMBER 403 | 1 | 0 | 0 | 0 | 0 | 1 | 0 | 0 | 0 | 0 | 0 | 0 | 1 | 0 | 0 | 0 | 0 | 0 | 0 | 1 | 4 |
| | HEATING MEMBER 404 | 0 | 0 | 1 | 0 | 0 | 0 | 0 | 1 | 0 | 0 | 1 | 0 | 0 | 0 | 0 | 0 | 0 | 1 | 0 | 0 | 4 |
| 25.0% | HEATING MEMBER 403 | 0 | 0 | 1 | 0 | 0 | 0 | 0 | 1 | 0 | 0 | 0 | 1 | 0 | 0 | 1 | 0 | 0 | 0 | 0 | 0 | 4 |
| | HEATING MEMBER 404 | 0 | 1 | 0 | 0 | 1 | 0 | 0 | 0 | 0 | 1 | 0 | 0 | 1 | 0 | 0 | 0 | 1 | 0 | 0 | 1 | 6 |
| 30.0% | HEATING MEMBER 403 | 0 | 0 | 1 | 0 | 0 | 1 | 0 | 1 | 0 | 0 | 0 | 0 | 1 | 0 | 0 | 0 | 1 | 0 | 0 | 1 | 6 |
| | HEATING MEMBER 404 | 1 | 0 | 0 | 0 | 1 | 0 | 0 | 0 | 0 | 1 | 0 | 1 | 0 | 0 | 1 | 0 | 0 | 1 | 0 | 0 | 6 |
| 35.0% | HEATING MEMBER 403 | 0 | 1 | 0 | 0 | 0 | 1 | 0 | 0 | 1 | 0 | 1 | 0 | 0 | 1 | 1 | 0 | 1 | 0 | 0 | 1 | 8 |
| | HEATING MEMBER 404 | 1 | 0 | 0 | 1 | 0 | 0 | 1 | 0 | 0 | 1 | 0 | 1 | 0 | 0 | 0 | 0 | 0 | 0 | 1 | 0 | 6 |
| 40.0% | HEATING MEMBER 403 | 0 | 1 | 1 | 0 | 0 | 1 | 0 | 0 | 1 | 0 | 1 | 0 | 0 | 1 | 0 | 0 | 1 | 0 | 0 | 1 | 8 |
| | HEATING MEMBER 404 | 1 | 0 | 0 | 0 | 1 | 0 | 0 | 1 | 0 | 1 | 0 | 1 | 1 | 0 | 0 | 1 | 0 | 0 | 1 | 0 | 8 |
| 45.0% | HEATING MEMBER 403 | 0 | 1 | 1 | 0 | 0 | 1 | 0 | 0 | 1 | 0 | 0 | 0 | 0 | 1 | 1 | 0 | 1 | 1 | 0 | 0 | 8 |
| | HEATING MEMBER 404 | 1 | 0 | 0 | 1 | 0 | 0 | 1 | 1 | 0 | 1 | 1 | 0 | 1 | 0 | 0 | 1 | 0 | 0 | 1 | 1 | 10 |
| 50.0% | HEATING MEMBER 403 | 0 | 1 | 1 | 0 | 1 | 1 | 0 | 0 | 1 | 1 | 0 | 0 | 0 | 1 | 1 | 0 | 1 | 0 | 0 | 1 | 10 |
| | HEATING MEMBER 404 | 1 | 0 | 0 | 1 | 0 | 0 | 1 | 1 | 0 | 0 | 1 | 1 | 1 | 0 | 0 | 1 | 0 | 1 | 1 | 0 | 10 |
| 55.0% | HEATING MEMBER 403 | 0 | 1 | 1 | 0 | 1 | 1 | 0 | 1 | 1 | 0 | 1 | 0 | 0 | 1 | 1 | 0 | 1 | 1 | 0 | 1 | 12 |
| | HEATING MEMBER 404 | 1 | 0 | 0 | 1 | 0 | 1 | 1 | 0 | 0 | 1 | 0 | 1 | 1 | 0 | 1 | 1 | 0 | 0 | 1 | 0 | 10 |
| 60.0% | HEATING MEMBER 403 | 0 | 1 | 1 | 0 | 1 | 1 | 0 | 1 | 1 | 0 | 1 | 0 | 1 | 1 | 0 | 1 | 1 | 0 | 0 | 1 | 12 |
| | HEATING MEMBER 404 | 1 | 0 | 0 | 1 | 1 | 0 | 1 | 1 | 0 | 1 | 0 | 1 | 1 | 0 | 1 | 1 | 0 | 1 | 1 | 0 | 12 |
| 65.0% | HEATING MEMBER 403 | 1 | 1 | 0 | 1 | 1 | 1 | 0 | 1 | 1 | 0 | 1 | 0 | 1 | 1 | 0 | 0 | 1 | 1 | 0 | 0 | 12 |
| | HEATING MEMBER 404 | 1 | 0 | 1 | 1 | 0 | 1 | 1 | 0 | 0 | 1 | 1 | 1 | 1 | 0 | 1 | 1 | 0 | 1 | 1 | 1 | 14 |
| 70.0% | HEATING MEMBER 403 | 1 | 1 | 0 | 1 | 1 | 1 | 0 | 1 | 1 | 0 | 1 | 0 | 1 | 1 | 0 | 1 | 1 | 0 | 1 | 1 | 14 |
| | HEATING MEMBER 404 | 1 | 0 | 1 | 1 | 0 | 1 | 1 | 0 | 1 | 1 | 1 | 1 | 0 | 1 | 1 | 1 | 0 | 1 | 1 | 0 | 14 |
| 75.0% | HEATING MEMBER 403 | 1 | 1 | 1 | 0 | 1 | 1 | 0 | 1 | 1 | 1 | 1 | 0 | 1 | 1 | 1 | 1 | 1 | 1 | 0 | 1 | 16 |
| | HEATING MEMBER 404 | 1 | 0 | 1 | 1 | 0 | 1 | 1 | 1 | 0 | 1 | 1 | 1 | 1 | 0 | 0 | 1 | 1 | 0 | 1 | 1 | 14 |
| 80.0% | HEATING MEMBER 403 | 1 | 0 | 1 | 1 | 1 | 1 | 0 | 1 | 1 | 1 | 1 | 1 | 1 | 1 | 0 | 1 | 1 | 1 | 1 | 0 | 16 |
| | HEATING MEMBER 404 | 1 | 1 | 1 | 0 | 1 | 1 | 1 | 1 | 0 | 1 | 1 | 1 | 0 | 1 | 1 | 1 | 1 | 0 | 1 | 1 | 16 |
| 85.0% | HEATING MEMBER 403 | 1 | 1 | 1 | 1 | 0 | 1 | 1 | 0 | 1 | 1 | 1 | 0 | 1 | 1 | 1 | 1 | 1 | 1 | 0 | 1 | 16 |
| | HEATING MEMBER 404 | 1 | 0 | 1 | 1 | 1 | 1 | 1 | 1 | 1 | 1 | 1 | 1 | 1 | 1 | 0 | 1 | 1 | 1 | 1 | 1 | 18 |
| 90.0% | HEATING MEMBER 403 | 1 | 1 | 1 | 1 | 1 | 1 | 1 | 0 | 1 | 1 | 1 | 1 | 1 | 1 | 0 | 1 | 1 | 1 | 1 | 1 | 18 |
| | HEATING MEMBER 404 | 1 | 1 | 1 | 0 | 1 | 1 | 1 | 1 | 1 | 1 | 1 | 1 | 1 | 1 | 1 | 1 | 1 | 1 | 0 | 1 | 18 |
| 95.0% | HEATING MEMBER 403 | 1 | 1 | 1 | 1 | 1 | 1 | 1 | 1 | 1 | 1 | 1 | 1 | 1 | 1 | 1 | 1 | 1 | 1 | 1 | 1 | 20 |
| | HEATING MEMBER 404 | 1 | 1 | 1 | 1 | 0 | 1 | 1 | 1 | 1 | 1 | 1 | 1 | 1 | 1 | 1 | 0 | 1 | 1 | 1 | 1 | 18 |
| 100.0% | HEATING MEMBER 403 | 1 | 1 | 1 | 1 | 1 | 1 | 1 | 1 | 1 | 1 | 1 | 1 | 1 | 1 | 1 | 1 | 1 | 1 | 1 | 1 | 20 |
| | HEATING MEMBER 404 | 1 | 1 | 1 | 1 | 1 | 1 | 1 | 1 | 1 | 1 | 1 | 1 | 1 | 1 | 1 | 1 | 1 | 1 | 1 | 1 | 20 |

FIG. 9

| ON/OFF RATIO | HEATING MEMBER | ON/OFF TABLE IN HALF WAVE UNIT (1: ON 2: OFF) | | | | | | | | | | | | | | | | | | | | |
|---|---|---|---|---|---|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | 15 | 16 | 17 | 18 | 19 | 20 | |
| 0.0% | HEATING MEMBER 403 | 0 | 0 | 0 | 0 | 0 | 0 | 0 | 0 | 0 | 0 | 0 | 0 | 0 | 0 | 0 | 0 | 0 | 0 | 0 | 0 | 0 |
| | HEATING MEMBER 404 | 0 | 0 | 0 | 0 | 0 | 0 | 0 | 0 | 0 | 0 | 0 | 0 | 0 | 0 | 0 | 0 | 0 | 0 | 0 | 0 | 0 |
| 5.0% | HEATING MEMBER 403 | 0 | 0 | 0 | 0 | 0 | 0 | 0 | 0 | 0 | 0 | 0 | 0 | 0 | 0 | 0 | 0 | 0 | 0 | 0 | 0 | 0 |
| | HEATING MEMBER 404 | 0 | 0 | 0 | 0 | 1 | 0 | 0 | 1 | 0 | 0 | 0 | 0 | 0 | 0 | 0 | 0 | 0 | 0 | 0 | 0 | 2 |
| 10.0% | HEATING MEMBER 403 | 0 | 0 | 0 | 0 | 0 | 0 | 0 | 0 | 1 | 0 | 0 | 1 | 0 | 0 | 0 | 0 | 0 | 0 | 0 | 0 | 2 |
| | HEATING MEMBER 404 | 1 | 0 | 0 | 1 | 0 | 0 | 0 | 0 | 0 | 0 | 0 | 0 | 0 | 0 | 0 | 0 | 0 | 0 | 0 | 0 | 2 |
| 15.0% | HEATING MEMBER 403 | 1 | 0 | 0 | 1 | 0 | 0 | 0 | 0 | 0 | 0 | 0 | 0 | 0 | 0 | 0 | 0 | 1 | 0 | 0 | 1 | 4 |
| | HEATING MEMBER 404 | 0 | 0 | 0 | 0 | 0 | 0 | 0 | 0 | 1 | 0 | 0 | 1 | 0 | 0 | 0 | 0 | 0 | 0 | 0 | 0 | 2 |
| 20.0% | HEATING MEMBER 403 | 0 | 0 | 0 | 0 | 1 | 0 | 0 | 1 | 0 | 0 | 0 | 0 | 1 | 0 | 0 | 1 | 0 | 0 | 0 | 0 | 4 |
| | HEATING MEMBER 404 | 0 | 1 | 1 | 0 | 0 | 0 | 0 | 0 | 0 | 1 | 1 | 0 | 0 | 0 | 0 | 0 | 0 | 0 | 0 | 0 | 4 |
| 25.0% | HEATING MEMBER 403 | 0 | 0 | 0 | 0 | 0 | 1 | 1 | 0 | 0 | 0 | 0 | 0 | 0 | 1 | 1 | 0 | 0 | 0 | 0 | 0 | 4 |
| | HEATING MEMBER 404 | 1 | 0 | 0 | 1 | 0 | 0 | 0 | 0 | 1 | 0 | 0 | 1 | 0 | 0 | 0 | 0 | 1 | 0 | 0 | 1 | 6 |
| 30.0% | HEATING MEMBER 403 | 0 | 1 | 1 | 0 | 0 | 0 | 0 | 0 | 1 | 1 | 0 | 0 | 0 | 1 | 1 | 0 | 0 | 0 | 0 | 0 | 6 |
| | HEATING MEMBER 404 | 0 | 0 | 0 | 0 | 1 | 0 | 0 | 1 | 0 | 0 | 1 | 1 | 0 | 0 | 0 | 0 | 1 | 0 | 0 | 1 | 6 |
| 35.0% | HEATING MEMBER 403 | 1 | 0 | 0 | 1 | 0 | 0 | 1 | 1 | 0 | 0 | 0 | 0 | 1 | 1 | 0 | 0 | 0 | 1 | 1 | 0 | 8 |
| | HEATING MEMBER 404 | 0 | 0 | 0 | 0 | 1 | 1 | 0 | 0 | 0 | 1 | 1 | 0 | 0 | 0 | 1 | 1 | 0 | 0 | 0 | 0 | 6 |
| 40.0% | HEATING MEMBER 403 | 0 | 0 | 1 | 1 | 0 | 0 | 0 | 0 | 1 | 1 | 0 | 0 | 0 | 1 | 1 | 0 | 1 | 0 | 0 | 1 | 8 |
| | HEATING MEMBER 404 | 1 | 1 | 0 | 0 | 0 | 1 | 1 | 0 | 0 | 0 | 1 | 1 | 0 | 0 | 0 | 0 | 0 | 1 | 1 | 0 | 8 |
| 45.0% | HEATING MEMBER 403 | 0 | 0 | 1 | 1 | 0 | 0 | 1 | 1 | 0 | 0 | 0 | 0 | 1 | 1 | 0 | 0 | 1 | 1 | 0 | 0 | 8 |
| | HEATING MEMBER 404 | 1 | 1 | 0 | 0 | 1 | 1 | 0 | 0 | 0 | 1 | 1 | 0 | 0 | 0 | 1 | 1 | 0 | 0 | 1 | 1 | 10 |
| 50.0% | HEATING MEMBER 403 | 1 | 0 | 0 | 1 | 0 | 1 | 1 | 0 | 1 | 0 | 0 | 1 | 0 | 1 | 1 | 0 | 1 | 0 | 0 | 1 | 10 |
| | HEATING MEMBER 404 | 0 | 1 | 1 | 0 | 1 | 0 | 0 | 1 | 0 | 1 | 1 | 0 | 1 | 0 | 0 | 1 | 0 | 1 | 1 | 0 | 10 |
| 55.0% | HEATING MEMBER 403 | 1 | 0 | 0 | 1 | 0 | 1 | 1 | 0 | 1 | 0 | 0 | 1 | 0 | 1 | 1 | 0 | 1 | 0 | 0 | 1 | 10 |
| | HEATING MEMBER 404 | 0 | 1 | 1 | 0 | 1 | 0 | 0 | 1 | 1 | 1 | 1 | 1 | 1 | 0 | 0 | 1 | 0 | 1 | 1 | 0 | 12 |
| 60.0% | HEATING MEMBER 403 | 0 | 1 | 1 | 0 | 1 | 0 | 0 | 1 | 1 | 0 | 0 | 1 | 1 | 1 | 1 | 1 | 1 | 0 | 0 | 1 | 12 |
| | HEATING MEMBER 404 | 1 | 0 | 0 | 1 | 1 | 1 | 1 | 1 | 0 | 1 | 1 | 0 | 1 | 0 | 0 | 1 | 0 | 1 | 1 | 0 | 12 |
| 65.0% | HEATING MEMBER 403 | 1 | 1 | 1 | 1 | 1 | 0 | 0 | 1 | 1 | 0 | 0 | 1 | 1 | 1 | 1 | 1 | 0 | 1 | 1 | 0 | 14 |
| | HEATING MEMBER 404 | 1 | 0 | 0 | 1 | 0 | 1 | 1 | 0 | 1 | 1 | 1 | 1 | 0 | 1 | 1 | 0 | 1 | 0 | 0 | 1 | 12 |
| 70.0% | HEATING MEMBER 403 | 1 | 1 | 1 | 1 | 1 | 0 | 0 | 1 | 0 | 1 | 1 | 0 | 1 | 0 | 0 | 1 | 1 | 1 | 1 | 1 | 14 |
| | HEATING MEMBER 404 | 0 | 1 | 1 | 0 | 1 | 1 | 1 | 1 | 1 | 0 | 0 | 1 | 1 | 1 | 1 | 1 | 0 | 1 | 1 | 0 | 14 |
| 75.0% | HEATING MEMBER 403 | 1 | 0 | 0 | 1 | 1 | 1 | 1 | 1 | 1 | 0 | 0 | 1 | 1 | 1 | 1 | 1 | 1 | 0 | 0 | 1 | 14 |
| | HEATING MEMBER 404 | 1 | 1 | 1 | 1 | 0 | 1 | 1 | 0 | 1 | 1 | 1 | 1 | 0 | 1 | 1 | 0 | 1 | 1 | 1 | 1 | 16 |
| 80.0% | HEATING MEMBER 403 | 1 | 1 | 1 | 1 | 1 | 0 | 0 | 1 | 1 | 1 | 1 | 1 | 0 | 1 | 1 | 0 | 1 | 1 | 1 | 1 | 16 |
| | HEATING MEMBER 404 | 0 | 1 | 1 | 0 | 1 | 1 | 1 | 1 | 1 | 1 | 1 | 1 | 1 | 1 | 1 | 1 | 1 | 0 | 0 | 1 | 16 |
| 85.0% | HEATING MEMBER 403 | 1 | 1 | 1 | 1 | 1 | 1 | 1 | 1 | 1 | 1 | 1 | 1 | 1 | 1 | 1 | 1 | 0 | 1 | 1 | 0 | 18 |
| | HEATING MEMBER 404 | 1 | 0 | 0 | 1 | 1 | 1 | 1 | 1 | 0 | 1 | 1 | 0 | 1 | 1 | 1 | 1 | 1 | 1 | 1 | 1 | 16 |
| 90.0% | HEATING MEMBER 403 | 1 | 1 | 1 | 1 | 0 | 1 | 1 | 0 | 1 | 1 | 1 | 1 | 1 | 1 | 1 | 1 | 1 | 1 | 1 | 1 | 18 |
| | HEATING MEMBER 404 | 1 | 1 | 1 | 1 | 1 | 1 | 1 | 1 | 1 | 1 | 1 | 1 | 0 | 1 | 1 | 0 | 1 | 1 | 1 | 1 | 18 |
| 95.0% | HEATING MEMBER 403 | 1 | 1 | 1 | 1 | 1 | 1 | 1 | 1 | 0 | 1 | 1 | 0 | 1 | 1 | 1 | 1 | 1 | 1 | 1 | 1 | 18 |
| | HEATING MEMBER 404 | 1 | 1 | 1 | 1 | 1 | 1 | 1 | 1 | 1 | 1 | 1 | 1 | 1 | 1 | 1 | 1 | 1 | 1 | 1 | 1 | 20 |
| 100.0% | HEATING MEMBER 403 | 1 | 1 | 1 | 1 | 1 | 1 | 1 | 1 | 1 | 1 | 1 | 1 | 1 | 1 | 1 | 1 | 1 | 1 | 1 | 1 | 20 |
| | HEATING MEMBER 404 | 1 | 1 | 1 | 1 | 1 | 1 | 1 | 1 | 1 | 1 | 1 | 1 | 1 | 1 | 1 | 1 | 1 | 1 | 1 | 1 | 20 |

FIG. 12

| | | FIRING ANGLE | | | |
|---|---|---|---|---|---|
| OUTPUT | HEATING MEMBER | FIRST HALF WAVE | SECOND HALF WAVE | THIRD HALF WAVE | FOURTH HALF WAVE |
| 0.0% | HEATING MEMBER 1 | 0 | 0 | 0 | 0 |
| | HEATING MEMBER 2 | 0 | 0 | 0 | 0 |
| 10.0% | HEATING MEMBER 1 | 0 | 3 | 3 | 0 |
| | HEATING MEMBER 2 | 1 | 0 | 0 | 1 |
| 20.0% | HEATING MEMBER 1 | 0 | 6 | 6 | 0 |
| | HEATING MEMBER 2 | 2 | 0 | 0 | 2 |
| 30.0% | HEATING MEMBER 1 | 0 | 8 | 8 | 0 |
| | HEATING MEMBER 2 | 4 | 0 | 0 | 4 |
| 40.0% | HEATING MEMBER 1 | 0 | 10 | 10 | 0 |
| | HEATING MEMBER 2 | 6 | 0 | 0 | 6 |
| 50.0% | HEATING MEMBER 1 | 4 | 10 | 10 | 4 |
| | HEATING MEMBER 2 | 6 | 0 | 0 | 6 |
| 60.0% | HEATING MEMBER 1 | 6 | 10 | 10 | 6 |
| | HEATING MEMBER 2 | 8 | 0 | 0 | 8 |
| 70.0% | HEATING MEMBER 1 | 8 | 10 | 10 | 8 |
| | HEATING MEMBER 2 | 10 | 0 | 0 | 10 |
| 80.0% | HEATING MEMBER 1 | 10 | 10 | 10 | 10 |
| | HEATING MEMBER 2 | 10 | 2 | 2 | 10 |
| 90.0% | HEATING MEMBER 1 | 10 | 10 | 10 | 10 |
| | HEATING MEMBER 2 | 10 | 6 | 6 | 10 |
| 100.0% | HEATING MEMBER 1 | 10 | 10 | 10 | 10 |
| | HEATING MEMBER 2 | 10 | 10 | 10 | 10 |

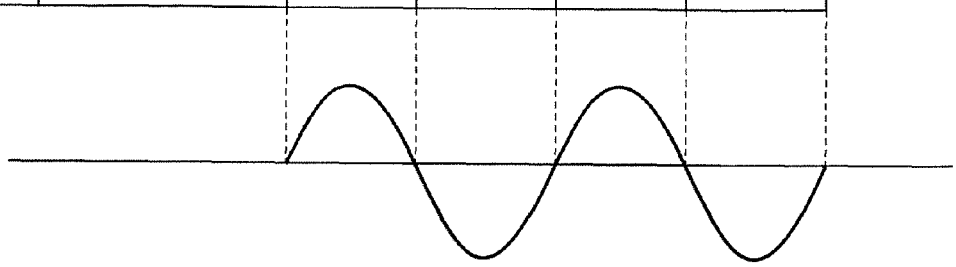

A: TEMPERATURE DETECTION TIMING

B: PATTERN (IN 4 HALFWAVES UNIT) SWITCH TIMING

FIXING APPARATUS WITH CURRENT CONTROL TO HEATER

This application is a divisional of U.S. patent application Ser. No. 11/215,972, filed Sep. 1, 2005.

BACKGROUND OF THE INVENTION

1. Field of the Invention

The present invention relates to an image forming apparatus for fixing an unfixed image formed on a transfer medium, and a control method therefor.

2. Related Background Art

An image forming apparatus for forming an image by an electrophotographic process is provided with a charging unit for uniformly charging a photosensitive surface of a photosensitive drum. It is also provided with a latent image forming unit for forming an electrostatic latent image corresponding to image information on thus charged photosensitive surface, a developing unit for developing such electrostatic latent image, a transfer unit for transferring the developed latent image onto a recording material, and a fixing apparatus for fixing thus transferred image onto the recording material.

Such fixing apparatus is equipped with a heating member which generates heat by a current supply. Such fixing apparatus includes a heat roller type, utilizing a halogen heater as a heating member, and a film heating type, utilizing a ceramic heater as a heating member. In the fixing apparatus of the heat roller type, a recording medium is introduced in and conveyed through a fixing nip portion formed by a fixing roller maintained at a predetermined temperature by heating with a halogen heater, and an elastic pressure roller maintained in pressed contact therewith, whereby an unfixed toner image on the recording medium is heat fixed by the heat of the fixing roller. In such type, since the fixing roller has a large heat capacity, a long time is required for reaching a predetermined temperature for executing a fixing operation, thereby resulting in a waiting time. Also in order to elevate the temperature within a short time, it is necessary to pre-heat the fixing apparatus by a current supply thereto during a stand-by state of the image forming apparatus, whereby the electric power consumption may become higher.

In consideration of these points, a fixing apparatus of film heating type is practiced commercially (such type being hereinafter represented as on-demand fixing method). In a fixing apparatus of film heating type, a recording material is contacted with a heating member, supported on a support member, across a thin heat-resistant film material, whereby the heat of the heating member is transmitted to the recording material through the film material. In this type, there can be employed so-called ceramic heater, basically constituted of a substrate of a low heat capacity enabling a fast temperature elevation, such as an insulating ceramic substrate of a high thermal conductivity, and a heat-generating resistor layer provided on the surface of such substrate and generating heat by a current supply. Also there can be employed a thin film material of a low heat capacity, whereby the temperature of the fixing apparatus can be elevated within a short time. Thus the fixing apparatus need not be energized during the stand-by state and it is rendered possible, when a recording material to be heated is introduced, to heat the fixing apparatus to a predetermined temperature before the recording material reaches the fixing nip portion. In this manner it is made possible to shorten the waiting time and to save the electric power consumption, and to suppress a temperature elevation in the main body of the image forming apparatus.

Such fixing apparatus is equipped with a temperature control apparatus as shown in FIG. 10. A heating member 1001 is connected, through a switching element 1002 such as a triac, to an AC power source 1007 such as a commercial power source, which supplies an electric power. Also there is provided a temperature detecting element 1003, such as a thermistor, which detects the temperature of the fixing apparatus. Information on the detected temperature is subjected to an analog-to-digital conversion by an A/D converter 1004, and supplied to a personal computer 1005. Based on the entered temperature information, the computer 1005 supplies a control circuit 1006 with control information so as to reach a predetermined temperature, and the control circuit 1006 controls an on/off (current supply/current non-supply) operation of the switching element 1002. In this manner the switching element 1002 controls a duty ratio of the AC power supply to the heating member 1001.

Such on/off control is executed by a wave number control or a phase control of the AC power source. The wave number control or the phase control is executed by a triggering based on a signal which includes a point where the entered AC power supply is switched from positive to negative or from negative to positive and which indicates that a magnitude of the power supply voltage has reached a certain threshold value or less (such signal being hereinafter represented as zero-cross signal). More specifically, a temperature control by a phase control is executed by changing a phase angle of the AC current based on the temperature information detected by the temperature detecting element (for example by controlling a switch timing of the triac). Such phase angle control may be executed by a method of executing a temperature detection and determining a phase angle accordingly, or by a method of executing a temperature detection at a constant interval and adopting a predetermined output pattern accordingly. Such output pattern is executed with a combination of a predetermined fixed wave number and a phase angle enabling an optimum temperature control as a function of the temperature.

Also a wave number control method controls an on/off state for every half wave of the power supply waveform, as shown in FIG. 11. A predetermined electric power is supplied to the heating member 1001 by a current supply for example in solid-lined portions. In such wave number control, in order to achieve an extract temperature control of the fixing apparatus, the control is executed by setting an on/off pattern, taking plural half-wave portions as a block. More specifically, the control is executed utilizing a control table, which sets an on/off pattern for controlling the power supply amount to the heating member per unit time, by taking plural half-waves as a control block and by selecting an on/off ratio (duty ratio) in the unit of a half-wave.

On the other hand, the non-demand fixing method is known to be associated with a following drawback. In the on-demand fixing method, because of a low heat capacity, the precision of the temperature control is improved by frequency changing the electric power supply amount. Therefore, the electric power supply amount changes more frequently than in the heat roller method. For example, in the heat roller method, the temperature can be maintained within a predetermined range by an electric power change in every 5 seconds, because of a large heat capacity. On the other hand, in the on-demand fixing method, the temperature cannot be maintained within a predetermined range unless the electric power is changed several times within a second. Such fluctuation in the electric power consumption (current consumption) induces a fluctuation in the power supply voltage. Particularly in case of a power source of a high line impedance (for example in case of a long distance from a transformer in a power supply line and a power supply line of a high resistance), the power supply voltage fluctuates frequently and significantly, thus causing a flickering of illumination or a television image (such phenomenon being hereinafter called flickering). In the wave number control, for example in case of controlling the duty ratio by a unit of 5%, the control is executed for example by taking 20 half-waves as a group and turning on several half-waves in a former half and turning off several half-waves in a latter half for achieving an electric power control in 10 levels, and, in such case, a frequency of current change becomes as low as 5 Hz whereby the flickering becomes easily noticed by human eyes.

Also in an image forming apparatus of a higher process speed requiring a larger electric power, a maximum electric power has to be increased by reducing the resistance of the heater, but the flickering phenomenon becomes aggravated as the electric power of the heater becomes larger, because the current fluctuation at on/off operation becomes even larger.

Also the flickering phenomenon becomes most serious when the electric power consumption of the fixing apparatus becomes smaller. For example, when the temperature control is executed from a cooled state of the fixing apparatus, all the waves are turned on because a large electric power is required, so that the consumption of the electric power from the power source scarcely fluctuates. On the other hand, when the fixing apparatus is warmed up and requires a low electric power, the electric power consumption shows a large fluctuation when the on-time (wave numbers) decreases with respect to the off-time, thereby aggravating the flickering phenomenon.

In order to avoid such situation, Japanese Patent Application Laid-open Nos. 09-258598 and 2004-138839 propose a method of providing the heating unit of the fixing apparatus with plural heating members and selecting a number of energized heating members according to a control state of the heating members, thereby switching an apparent resistance. In this method, more specifically, two heating members are simultaneously energized when a large electric power is required as in a start-up state from a low temperature, and one heating member only is frequently turned on and off in a state where the temperature reaches a predetermined value and is maintained constant. Such control method enables a high-speed temperature elevation from a low temperature state by simultaneously energizing plural heating members, and, during a temperature maintaining state, allows to reduce a fluctuation in the electric power consumption in on/off operations, thereby suppressing the flickering phenomenon.

As the electric power supply to the heating unit is usually executed directly from the commercial AC power source, it is necessary to have a same duty ratio in the positive and negative sides of the AC power supply in a unit time (positive-negative symmetry), in order not to give a detrimental effect on the power source. However, in a wave number control by a unit of half-wave for the temperature control of the heating unit, such positive-negative symmetry cannot be attained when the plural heating members have different resistances, thereby leading to a flickering problem. In case the heating members 1 and 2 have different resistances, a summed current waveform of the heating members 1 and 2 does not become symmetrical even in case of a positive-negative symmetry in the AC input.

On the other hand, a control in the full-wave unit can always achieve the positive-negative symmetry but leads to a rough control thereby inducing a temperature ripple. Also the flickering may increase because the on/off interval becomes longer.

SUMMARY OF THE INVENTION

The present invention has been made in consideration of the aforementioned drawbacks, and is to solve such drawbacks in the prior technologies.

An object of the present invention is to solve the drawbacks of the prior technology and to provide an image forming apparatus, capable of suppressing a flickering phenomenon thereby preventing detrimental effects on the power source, and a control method therefor.

The aforementioned feature is attained by a combination of characteristics described in a main claim, and sub claims define specific embodiments advantageous for the invention.

Outline of the present invention does not necessarily include all the necessary characteristics, so that a sub combination of such characteristics can also constitute an invention.

Other features, objects and advantages of the present invention will be apparent from the following description when taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 6 is a view showing a configuration of a control table in a first embodiment;

FIG. 9 is a view showing a configuration of a control table in a second embodiment;

FIG. 12 is a view showing a ratio of electric powers supplied to the two heaters in the unit of 4 half-waves.

DETAILED DESCRIPTION OF THE PREFERRED EMBODIMENTS

In the following, preferred embodiments of the present invention will be explained in detail, with reference to the accompanying drawings. The following embodiments are not to restrict the claimed invention, and all the combinations of the features explained in the embodiments are not necessarily essential to the solving means of the invention.

Figure 1:
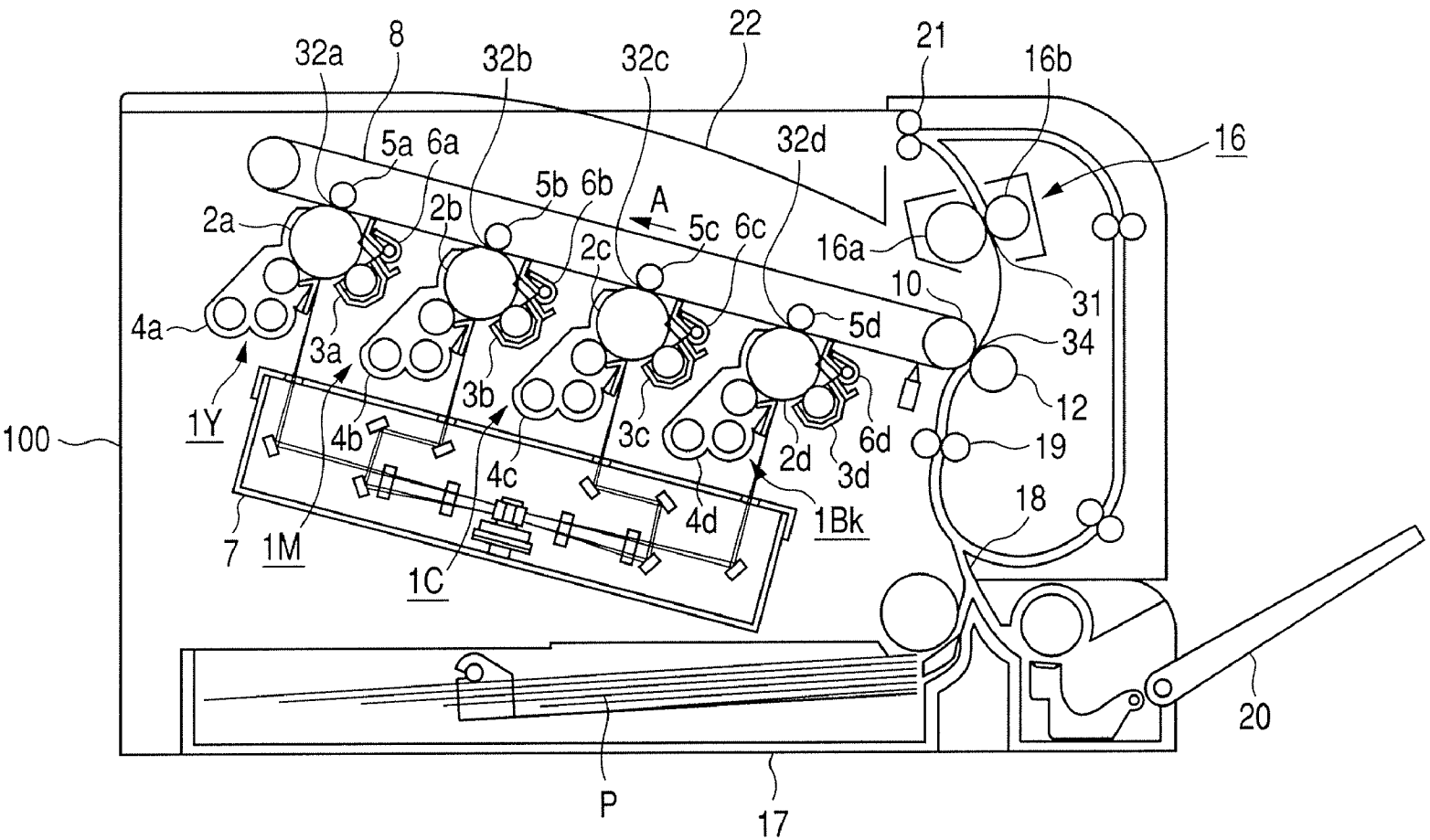
FIG. 1 is a schematic cross-sectional view showing a configuration of an electrophotographic image forming apparatus embodying the present invention.

FIG. 1 is a schematic plan view showing a configuration of an electrophotographic image forming apparatus embodying the present invention. The color image forming apparatus 100 is provided with four image forming portions (image forming units), namely an image forming unit 1Y for forming a yellow image; an image forming unit 1M for forming a magenta image; an image forming unit 1C for forming a cyan image; and an image forming unit 1Bk for forming a black image. These four image forming portions 1Y, 1M, 1C and 1Bk are arranged linearly with a constant interval. The image forming portions 1Y, 1M, 1C, 1Bk are respectively provided with drum-shaped photosensitive members (hereinafter called photosensitive drums) 2*a*, 2*b*, 2*c*, 2*d* as image bearing members. Around the photosensitive drums 2*a*, 2*b*, 2*c*, 2*d*, there are respectively provided primary chargers 3*a*, 3*b*, 3*c*, 3*d*, developing units 4*a*, 4*b*, 4*c*, 4*d*, transfer rollers 5*a*, 5*b*, 5*c*, 5*d* serving as transfer means, and drum cleaners 6*a*, 6*b*, 6*c*, 6*d*. A laser exposure apparatus 7 is provided below the spaces between the primary chargers 3*a*, 3*b*, 3*c*, 3*d* and the developing units 4*a*, 4*b*, 4*c*, 4*d*. The developing units 4*a*, 4*b*, 4*c*, 4*d* respectively store a yellow toner, a cyan toner, a magenta toner and a black toner. In the following there will be explained an image forming operation by the aforementioned image forming apparatus.

In response to an image formation start signal, the photosensitive drums 2*a*, 2*b*, 2*c*, 2*d* of the image forming portions 1Y, 1M<1C, 1Bk, rotated at a predetermined process speed, are uniformly charged negatively, respectively by the primary chargers 3*a*, 3*b*, 3*c*, 3*d*. Then the exposure apparatus 7 emits lights through a polygon lens and mirrors, according to color separated image signals supplied from the exterior, thereby forming electrostatic latent images of respective colors on the photosensitive drums 2*a*, 2*b*, 2*c*, 2*d*.

On the electrostatic latent image formed on the photosensitive drum 2*a*, a yellow toner is deposited, by the developing apparatus 4*a* which receives a developing bias of a polarity same as that of the charging polarity (negative) of the photosensitive drum 2*a*, thereby obtaining a visible toner image. Such yellow toner image is subjected to a primary transfer onto an intermediate transfer belt 8, in a primary transfer portion 32*a* between the photosensitive drum 2*a* and the transfer roller 5*a*, by the transfer roller 5*a* which receives a primary transfer bias (of a polarity (positive) opposite to that of the toner).

The intermediate transfer belt 8, having received the yellow toner image, moves to an image forming portion 1M. Also in the image forming portion 1M, as described in the foregoing, the magenta toner image formed on the photosensitive drum 2*b* is transferred, in the primary transfer portion 32*b*, onto the intermediate transfer belt 8 in superposition with the yellow toner image thereon. In these operations, transfer residual toners remaining on the photosensitive drums 2 are scraped off and recovered by cleaner blades provided in the drum cleaners 6*a*, 6*b*, 6*c*, 6*d*. Thereafter, cyan and black toner images formed on the photosensitive drums 2*c*, 2*d* of the image forming portions 1C, 1Bk are similarly superposed in succession, in the primary transfer portions 32*a* to 32*d*, onto the yellow and magenta toner images transferred in superposition onto the intermediate transfer belt 8, thereby forming a full-color toner image thereon.

Then, in synchronization with a timing when a leading end of the full-color toner image on the intermediate transfer belt 8 reaches a secondary transfer portion 34 between a secondary transfer counter roller 10 and a secondary transfer roller 12, a transfer material (paper) P selected from a sheet cassette 17 or a manual insertion tray 20 and supplied through a conveying path 18 is conveyed by registration rollers 19 to the secondary transfer portion 34. The full-color toner image is subjected to a collective secondary transfer onto the transfer material P thus conveyed to the secondary transfer portion 34, by the secondary transfer roller 12 which receives a secondary transfer bias (of a polarity (positive) opposite to that of the toner).

The transfer material P, bearing the full-color toner image, is conveyed to a fixing apparatus 16, and, after a heat fixation of the full-color toner image onto the transfer material P under heat and pressure in a fixing nip portion 31 between a fixing roller 16*a* and a pressure roller 16*b*, is discharged by sheet discharge rollers 21 onto a discharge tray 22 on an upper surface of the main body, whereby serial image forming operations are completed.

Figure 2:
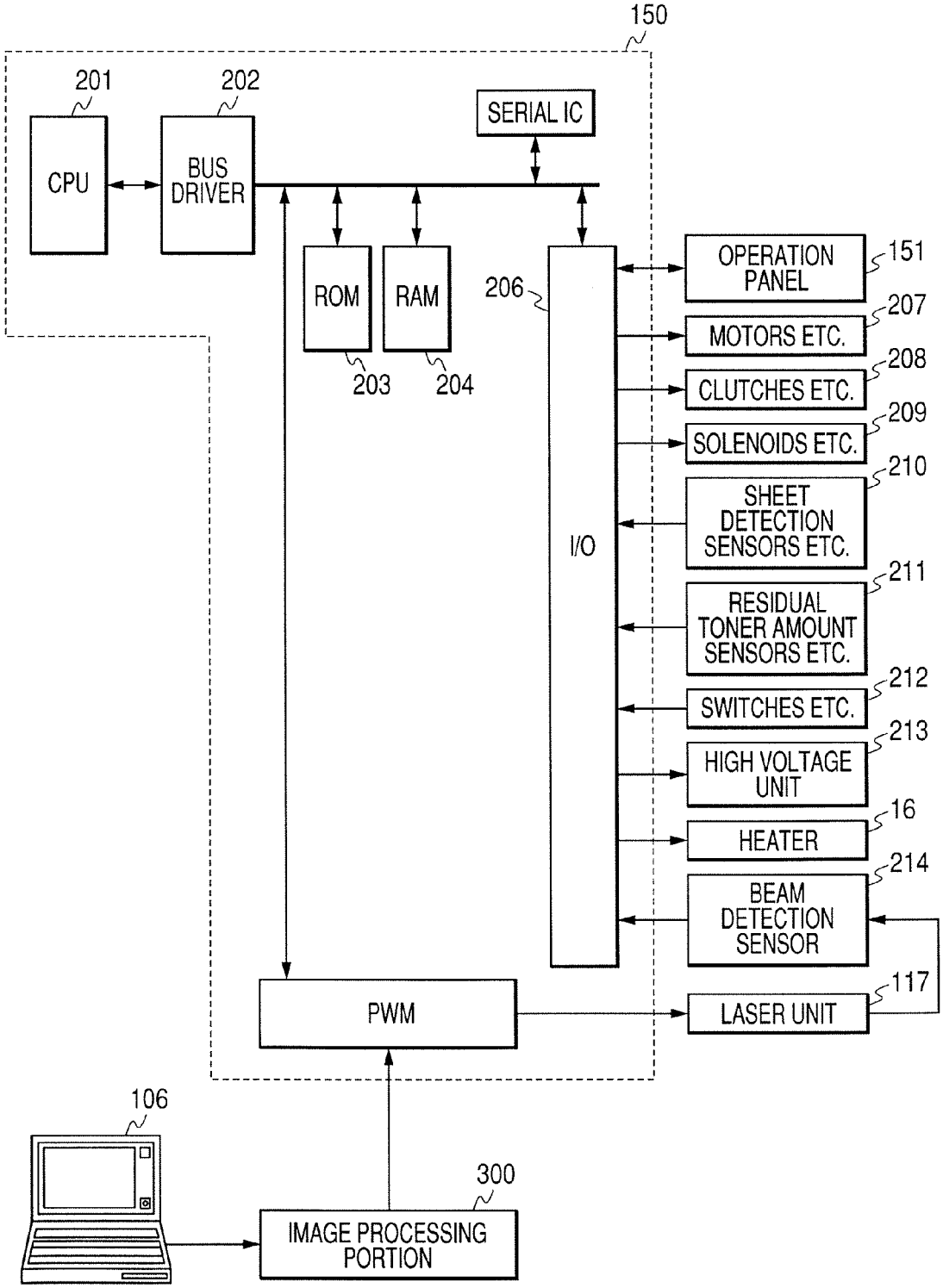
FIG. 2 is a schematic block diagram showing a configuration of a controller unit and an image processing unit in an image forming apparatus embodying the present invention.

FIG. 2 is a schematic block diagram of a controller 150 and an image processing portion 300, for controlling the color image forming apparatus shown in FIG. 1. A CPU 201 executes a basic control of the image forming apparatus 100, reading and executing programs from a ROM (read-only memory) 203 storing control sequences (control programs). An address bus and a data bus of the CPU 201 are connected, through a bus driver and an address decoder circuit 202, to various loads. A RAM (random access memory) 204 is a main memory used for storing input data and as a work memory area.

An I/O port 206 is connected to various loads, such as an operation panel 151 for a key input by the operator and for a status display by a liquid crystal display or an EL, motors 207, clutches 208, and solenoids 209 for driving a paper feeding system, a conveying system and an optical system, and sheet sensors 210. Each image forming portion is provided with a toner amount sensor 211 for detecting a toner amount in the developing device, of which an output signal is supplied to the I/O port 206. Also signals of switches 212 for detecting home positions of various loads and an open/close state of a door of the apparatus are also supplied to the I/O port 206. A high-voltage unit 213 outputs, under instructions of the CPU, high voltages to the primary chargers 3, the developing units 4, the primary transfer portions and the secondary transfer portions. A heater (heating member) 14 receives a supply of an AC voltage according to an on/off signal.

An image processing portion 300 is also provided with a CPU which communicates by serial signals with the CPU 201 for exchanging for example an output timing to an engine unit. It also executes an image processing on an image signal supplied from a connected personal computer 106, and outputs image data to the engine unit. Laser beams emitted from a laser unit 117, according to the image data from the image processing portion 300, irradiate and expose the photosensitive drums, and also a light emitting state is detected, in a non-image area, by beam detector 214 of which output signal is supplied to the I/O port 206.

Figure 3:
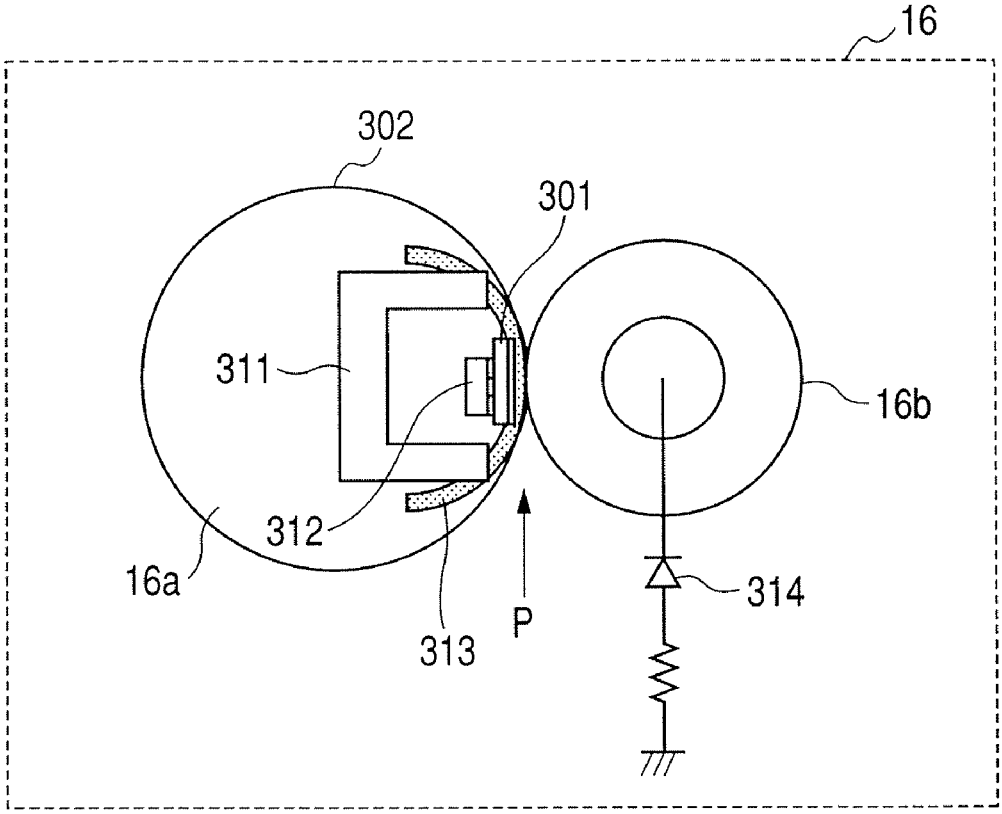
FIG. 3 is a schematic view showing a fixing apparatus embodying the present invention.

FIG. 3 is a schematic view showing an example of the fixing apparatus of the color image forming apparatus shown in FIG. 1, wherein shown are a ceramic heater 301, a fixing film 302, a pressure roller 303, a square C-shaped plate 311, a temperature detecting thermistor 312, a holder 313 and a self-bias circuit 314. The ceramic heater 301 is constituted of a heating member formed by printing heat-generating pattern on a ceramic material (cf. FIG. 4), and has a very high response of showing a temperature increase of about 50° C. in 1 second. The fixing film 302 is formed by a metal base material, a rubber layer of a thickness of about 300 μm thereon and a fluorine surface treatment, and has an extremely small heat capacity and transmits the heat of heater only to the nip portion. A roller 16*b* of a hardness of about 60° frictionally drives the fixing film 302. A square C-shaped metal plate 311 presses the fixing film 302 from the inner side toward the pressure roller 303, with a pressure of about 180 N. The thermistor 312 for detecting the heater temperature is a main thermistor positioned at the center of the heater detecting a temperature for controlling the fixing temperature. A sub thermistor (not shown) at an end of the heater detects a temperature rise in a sheet non-passing area when a small-sized sheet P is passed.

Figure 4:
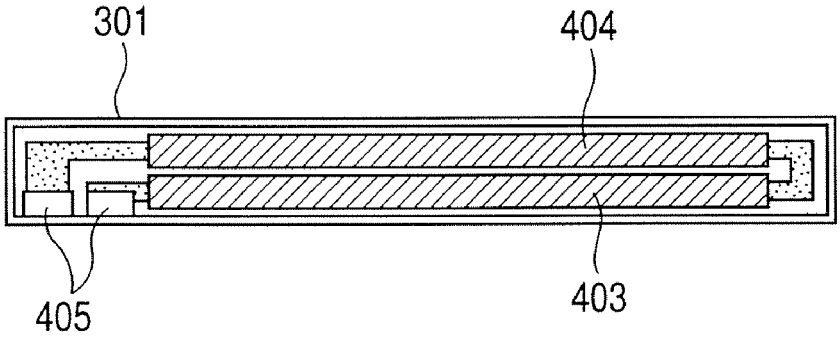
FIG. 4 is a plan view showing a heater embodying the present invention.

FIG. 4 is a plan view of the heater 301 shown in FIG. 3, including heating members 403, 404 and electrodes 405. The heating members 403, 404 generate heat by a voltage application to the electrodes 405. A pattern of the heating members in the present heater is merely an example, and may be varied according to the characteristics of the fixing apparatus.

Figure 5:
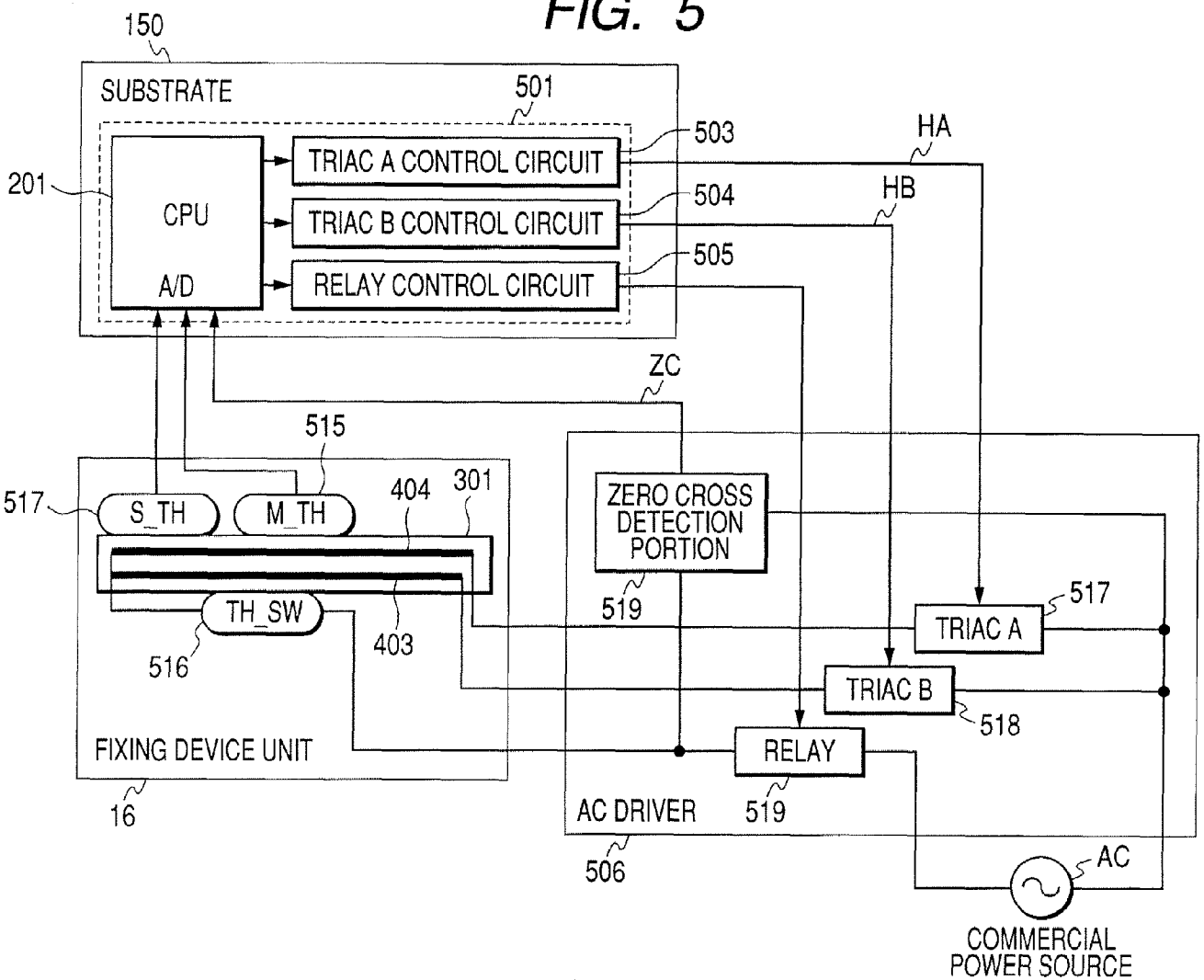
FIG. 5 is a circuit diagram showing a configuration of a heater drive/control circuit embodying the present invention.

FIG. 5 is a circuit diagram showing a configuration of a heater drive/control circuit for driving and controlling the ceramic heater 301 in the fixing apparatus shown in FIG. 1.

It is constituted of a fixing device unit 16, a heater control portion 501 including a CPU 201 and provided on a substrate of the controller 150 of the image forming apparatus, and an AC driver 506 connected to a commercial power source, for supplying electric power to the entire image forming apparatus.

The fixing unit 16 is equipped with a ceramic heater 301 including the heating members 403, 404 and a thermistor 515 serving as temperature detecting means for detecting the temperature of the ceramic heater 301, and, for safety reason, is further provided with a sub thermistor 517 for detecting an abnormal temperature elevation in an end portion of the ceramic heater 301, and a thermo switch 516 for forcedly cutting off the current supply to the ceramic heater 301 in case of an abnormal temperature elevation caused by a failure of triacs to be explained later.

The heater control portion 501 is provided with a CPU 201 positioned on the control substrate 150, a triac A control circuit 503, a triac B control circuit 504 and a relay control circuit 505.

The AC driver 506 is provided, on an AC driver board 506, with a triac A 517 and a triac B 518 serving as switching elements, and a zero-cross detector 519, and, for safety reasons, also with a relay for cutting off the power supply to the ceramic heater 301 from the commercial power source AC.

Based on the temperature detected by the thermistor 515, the CPU 201 on the control substrate 150 controls the triac A control circuit 503 and the triac B control circuit 504, thereby controlling on-timings of the triac A 517 and the triac B 518 provided on the AC driver board 506, whereby the AC currents supplied to the two heating members 403, 404 of the ceramic heater 301 are independently controlled.

More specifically, the heating members 403, 404 are connected in parallel, and are respectively connected to the triac A 517 and the triac B 518 for controlling the supplied AC currents. The heating members 403, 404 have a ratio of resistances of about 1:1. The zero-cross detector 519 detects a zero-cross detecting range of several volts above and below a zero-cross point of the power supply voltage, and outputs a zero-cross detection signal ZC according to a preset zero-cross detection range.

The CPU 201 calculates current supply amounts to the heating members 403, 404 based on the temperature information detected by the thermistor 515, and generates heat control signals HA, HB for executing a wave number control from such current supply amount and the zero-cross signal ZC. The heater control signals HA, HB are respectively supplied, through the triac A control circuit 503 and the triac B control circuit 504, to the triac A 517 and the triac B 518, of which on/off states are respectively controlled by such heater control signals HA, HB.

Heater control signals HA, HB of a "high" level respectively trigger the triac A 517 and the triac B 518, thereby supplying the heating members 403, 404 with currents. The heater control signal HA controls the triac A 517 thereby controlling the current supplied to the heating member 404, while the heater control signal HB controls the triac A 518 thereby controlling the current supplied to the heating member 403. The current supplied to the both heating members 403, 404 has a waveform of a sum of the current supplied to the heating member 403 and the current supplied to the heating member 404.

In the present embodiment, since the heating members 403, 404 have approximately same resistance, the electric power consumption becomes about doubled when the current is supplied to the two heating members, in comparison with a case where the current is supplied only to either heating member, whereby a rapid temperature elevation can be realized in the entire ceramic heater 13.

In such circuit configuration, in order to control the surface temperature of the ceramic heater 301, the CPU 201 executes a control utilizing a control table to be explained in the following.

<Control Table in Present Embodiment>

FIG. 6 is a view showing an example of a control table of the first embodiment.

The CPU 201 selects, from such control table, duty ratios for the two heating members 403, 404 thereby independently controlling the AC currents to be supplied to the heating members 403, 404.

The control table is stored for example in a memory such as a ROM 203 provided on the control substrate 150, and is used at a temperature control process executed by the CPU 201 for controlling the surface temperature of the ceramic heater 301.

Referring to FIG. 6, duty ratios are set with a pitch of 5%, and an on/off pattern for each of the heating members at each duty ratio. The wave number control is prepared in a unit of 20 half-waves because the duty ratio is set with a pitch of 5%. A unit of 10 half-waves will be adopted for a duty ratio pitch of 10%, and a unit of 40 half-waves will be adopted for a duty ratio pitch of 2.5%.

In numbers 1 to 20, an odd number indicates a positive side in an input commercial power source, and an even number indicates a negative side.

In the following, there will be explained a rule for preparing the control table shown in FIG. 6.

The control table is prepared with a unit of 20 half-waves, and an electric power supply to the heating member per unit time is determined by a number of half-waves in a turn-on state within such 20 half-waves. Also the on/off pattern is so determined that the AC input from the commercial power source AC is uniformly supplied in the positive and negative sides, for each of the heating members 403, 404.

In the present embodiment, since both heating members 403, 404 have approximately same resistances, a pattern symmetrical in the positive and negative sides for the sum of both heating members seems acceptable, but in fact a positive-negative symmetrical pattern is required for each of the heating members 403 and 404 because of an error of several percent in the resistance for example due to a fluctuation in the manufacture.

Therefore the pattern is so determined as to be symmetrical for the positive and negative sides for the sum of the two heating members and also for each of the two heating members 403, 404.

Also in the present embodiment, in order to control the two heating members 403, 404 at a same temperature, the on/off pattern is so selected as to have a same duty ratio for the heating members 403, 404.

Thus, at every 10% level (10.0%, 20.0%, 30.0%, 40.0%, 50.0%, 60.5%, 70.5%, 80.5%, 90.0%, or 100%), the pattern is so selected as to be positive-negative symmetrical for the two heating members and for each of the heating members 403, 404.

Such pattern allows to avoid detrimental influences on the AC power source.

As described in the foregoing, the AC input has to be used symmetrically in the positive and negative sides in case of independently controlling the heating members 403, 404, but, under such restriction, the electric powers supplied the heating members 403, 404 cannot be made equal in certain cases. More specifically, at every 5% level (5.0%, 15.0%, 25.0%, 35.0%, 45.0%, 55.0%, 65.0%, 75.0%, 85.0%, or 95.0%), the supplied electric power becomes larger in either of the heating members 403, 404 when the AC input is used symmetrically in the positive and negative sides. In such case, a priority is given to the positive/negative symmetry by tolerating a difference by two half-waves. In this case, the on/off pattern is so prepared as to give a larger electric power to either of the two heating members, so that, at another nearby duty ratio level, the on/off pattern is so prepared as to give a larger electric power to the other of the two heating members. More specifically, in case a number of the ON-patterns is larger by 2 half-waves for the heating member 404 at 5.0% duty ratio, a number of the ON-patterns is larger by 2 half-waves for the heating member 403 at 15.0% duty ratio, which is close to the 5.0% level and at which the supplied electric powers to the heating members 403, 404 cannot be made equal. Then, since a number of the ON-patterns is larger by 2 half-waves for the heating member 403 at 15.0% duty ratio, a number of the ON-patterns is larger by 2 half-waves for the heating member 404 at 25.0% duty ratio, which is close to the 15.0% level and at which the supplied electric powers to the heating members 403, 404 cannot be made equal. The patterns are thereafter prepared by repeating this procedure.

In case a number of the ON-patterns is larger by 2 half-waves for the heating member 403 at 5.0% duty ratio, a number of the ON-patterns is larger by 2 half-waves for the heating member 404 at 15.0% duty ratio. The patterns are thereafter prepared by repeating this procedure.

Thus, in case the on/off pattern is so prepared at a certain duty ratio as to provide a larger electric power to either of the two heating members, the on/off pattern at another nearby duty ratio is so prepared as to provide a larger electric power to the other heating member.

In this manner it is rendered possible to suppress the flickering phenomenon and to prevent detrimental influences on the AC power source.

Also as a countermeasure for the flickering, the control table is so prepared that the on/off period becomes as short as possible and not regular.

<Temperature Control Process of CPU>

Figure 7:
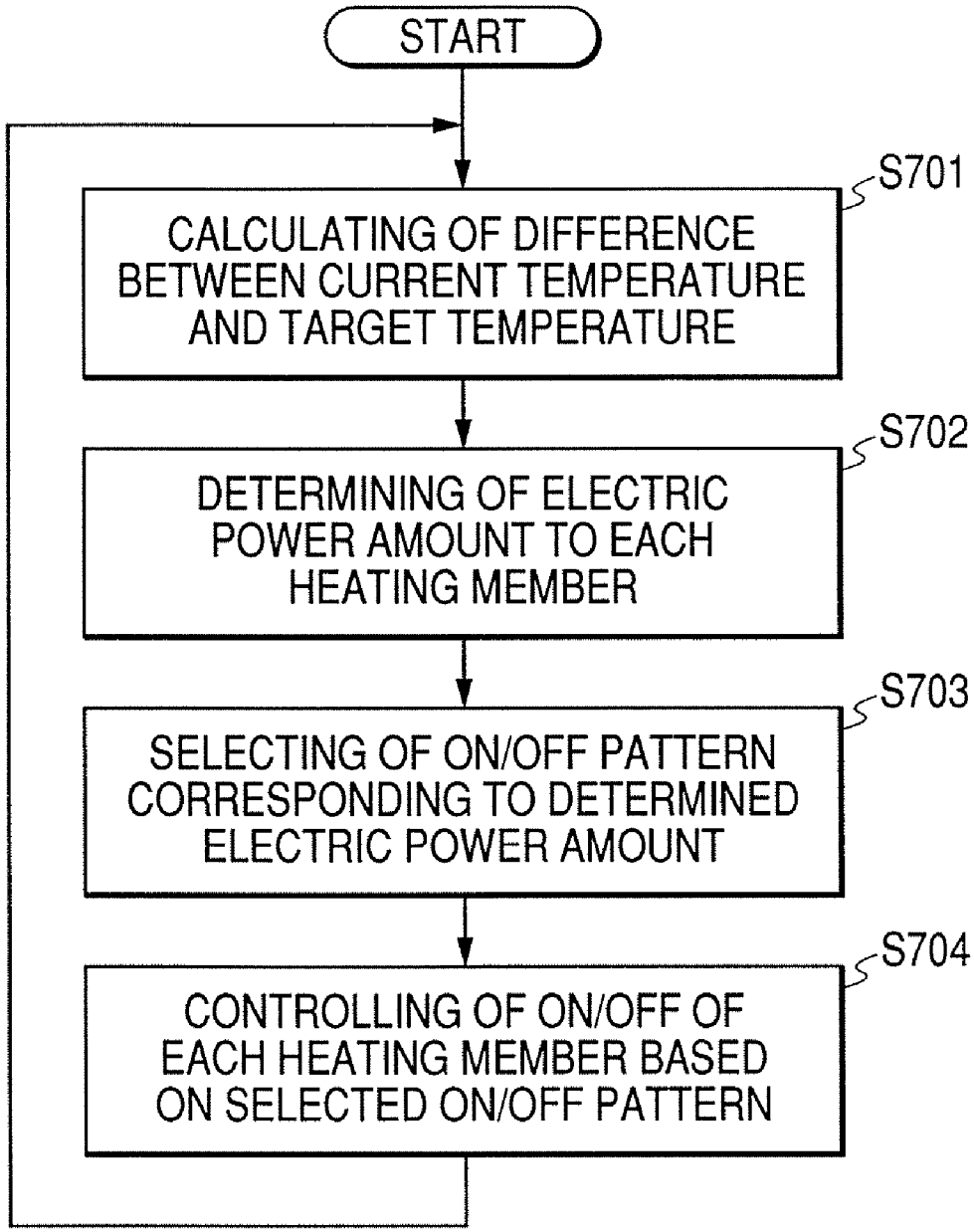
FIG. 7 is a flow chart showing a temperature control process executed with the control table of the first embodiment.

FIG. 7 is a flow chart showing a temperature control process executed by the CPU 201 utilizing the control table shown in FIG. 4.

For controlling the surface temperature of the ceramic heater 301, the CPU 201 at first calculates a difference between a current temperature detected by the thermistor 515 and a target temperature (step S701), and determines electric powers to be supplied to the heating members 403, 404, based on the difference between the current temperature and the target temperature (step S702).

Then it selects, from the control table, an on/off pattern corresponding to a duty ratio, which corresponds to the determined electric power (step S703). It then outputs, according to the selected on/off pattern, heater control signals HA, HB respectively to the triacs 517, 518 thereby controlling on/off states of the heating members 403, 404 (step S704).

<Current Waveform to Each Heating Member>

Figure 8A:
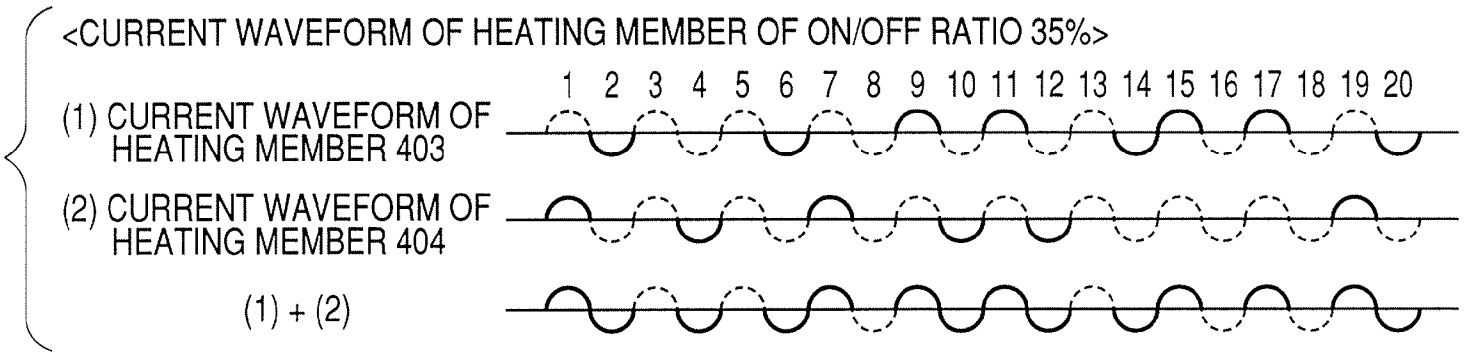
FIGS. 8A and 8B are waveform charts showing a current waveform of the first embodiment.
Figure 8B:
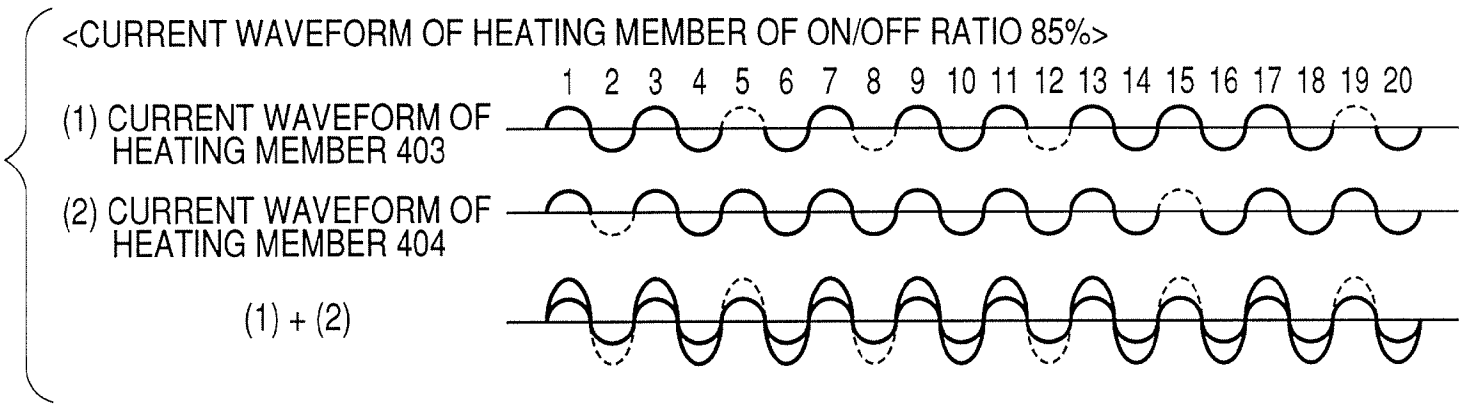
Figure 10:
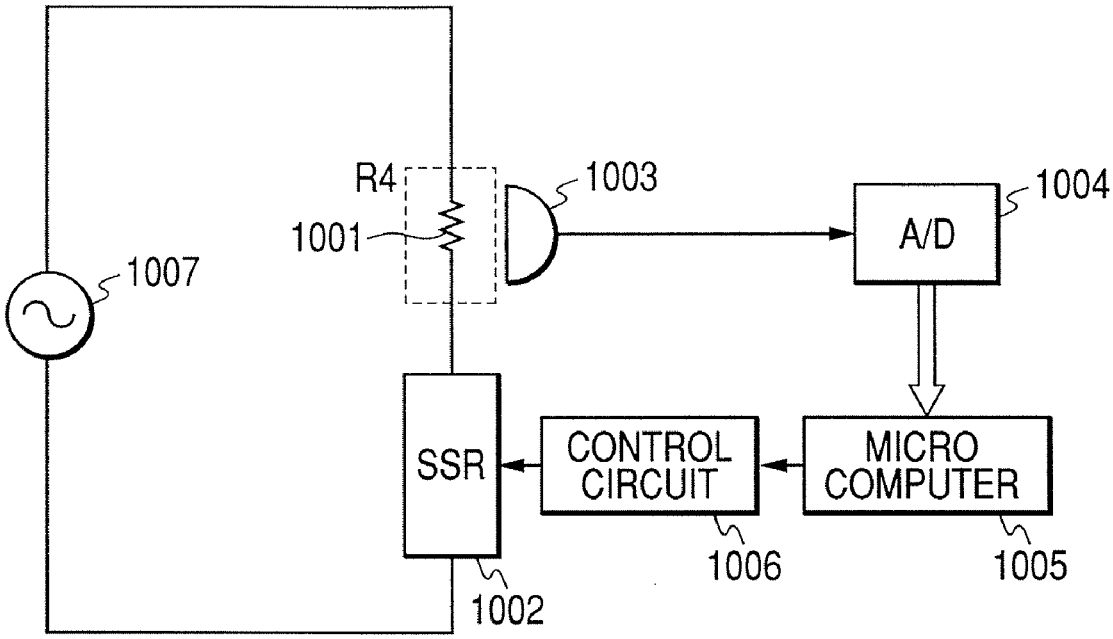
FIG. 10 is a view showing a temperature control apparatus.
Figure 11:
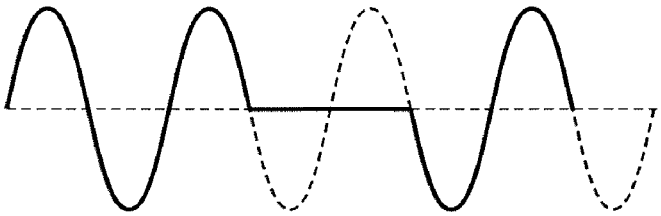
FIG. 11 is a view showing a wave number control method.

FIGS. 8A and 8B are waveform charts showing a current waveform supplied to the heating members 403, 404 in case of a temperature control according to the control table shown in FIG. 4, with an example (a) for a duty ratio 35% and an example (b) for a duty ratio 85%.

At a duty ratio for example of 35%, as shown in (1) of FIG. 8A, the current waveform for the heating member 403 is turned on at 4 half-waves at each of positive and negative sides (9th, 11th, 15th and 17th half-waves at the positive side, and 2nd, 6th, 14th and 20th half-waves at the negative side), thus being symmetrical in the positive and negative sides. For the heating member 404, as shown in (2) of FIG. 8A, the current waveform is turned on at 3 half-waves at each of positive and negative sides (1st, 7th and 19th half-waves at the positive side and 4th, 10th and 12th at the negative side), thus being also symmetrical in the positive and negative sides. The positive-negative symmetry is maintained also in (1)+(2) for both heating members.

At a duty ratio for example of 85%, as shown in (1) of FIG. 8B, the current waveform for the heating member 403 is turned on at 8 half-waves at each of positive and negative sides (1st, 3rd, 8th, 9th, 11th, 13th, 15th and 17th half-waves at the positive side, and 2nd, 4th, 6th, 10th, 14th, 16th, 18th and 20th half-waves at the negative side). For the heating member 404, the current waveform is turned on at 9 half-waves at each of positive and negative sides (1st, 3rd, 5th, 7th, 9th, 11th, 13th, 17th and 19th half-waves at the positive side, and 4th, 6th, 8th, 10th, 12th, 14th, 16th, 18th and 20th half-waves at the negative side). The positive-negative symmetry is maintained also in (1)+(2) for both heating members. Therefore, a complete positive-negative symmetrical control is attained in the unit of 20 half-waves also for the duty ratio of 85%.

As the control table is so constructed as to achieve a positive-negative symmetry for each of the heating members 403, 404 also at other duty ratios, the fixing apparatus of the present embodiment is capable of achieving a completely positive-negative symmetrical electric power control. In this manner it is rendered possible to suppress the flickering phenomenon and to prevent detrimental influences on the AC power source.

In the present embodiment, as explained in the foregoing, the supplied electric powers to the heating members 403, 404 cannot be made equal at certain duty ratios (5%, 15%, 25%, 35%, 45%, 55%, 65%, 75%, 85% and 95%). Therefore, the on/off pattern is so set, at a duty ratio 5%, as to provide a larger electric power supply in the heating member 404 than in the heating member 403, and, at a duty ratio 15%, as to provide a larger electric power supply in the heating member 403 than in the heating member 404, and the control table is so prepared as to provide a larger electric power alternately thereafter, whereby the heating members 403, 404 assume same temperature over a longer period.

As explained in the foregoing, the present embodiment allows, in case of independently controlling plural heating members, to obtain uniform electric powers at the positive and negative sides per unit time, thereby avoiding detrimental influences on the power source. Also a flickering phenomenon can be suppressed by an appropriate construction of the control table.

Also even in case a specified heating member receives a larger electric power for a certain duty ratio, the electric powers to the heating members can be made uniform over a longer period. It is therefore possible to maintain a temperature balance in a fixing heater, such as a ceramic heater, constituted of plural heating members.

Second Embodiment

The first embodiment utilizes a control table prepared in the use of 20 half-waves, but it may be desirable to switch the duty ratio in a shorter period, in the temperature control of the ceramic heater 13. Such situation arises in case of a large temperature change, for example in case of passing a thick paper in the nip portion N of the fixing unit 118. In the second embodiment, as a measure for such situation, adopts a basic unit of 20 half-waves but executes a switching to another duty ratio in the unit of 4 half-waves (not restrictive but any other divisor of 20). FIG. 9 shows a configuration of a control table of the second embodiment.

As will be apparent from FIG. 9, the control table of the second embodiment also realizes a completely positive-negative symmetrical control for each of the heating members 403, 404, in the unit of 4 half-waves or in the unit of 20 half-waves. In this manner it is rendered possible to switch the duty ratio in a shorter period, also to suppress the flickering phenomenon and to avoid detrimental influences on the power source.

The control method based on the control table of the second embodiment and the current waveforms to the heating members 403, 404 are similar to those in the above-described first embodiment and will not, therefore, be explained further.

These are also naturally applicable to other variations.

[Application to Phase Control]

Same duty ratios at the positive and negative sides of the AC power source per unit time (positive-negative symmetry), can be applied to a phase control.

FIG. 12 shows a ratio of electric powers supplied to the two heaters in the unit of 4 half-waves. In the table, an output (0-100%) indicates an electric power supplied in the unit of 4 half-waves for the two heaters. As shown in this table, there is adopted such a pattern as to provide equal electric powers in the positive and negative sides. Such pattern allows to provide same electric powers in the 4 half-waves, even when the heating members 403 and 404 have different electric powers.

Figure 13:
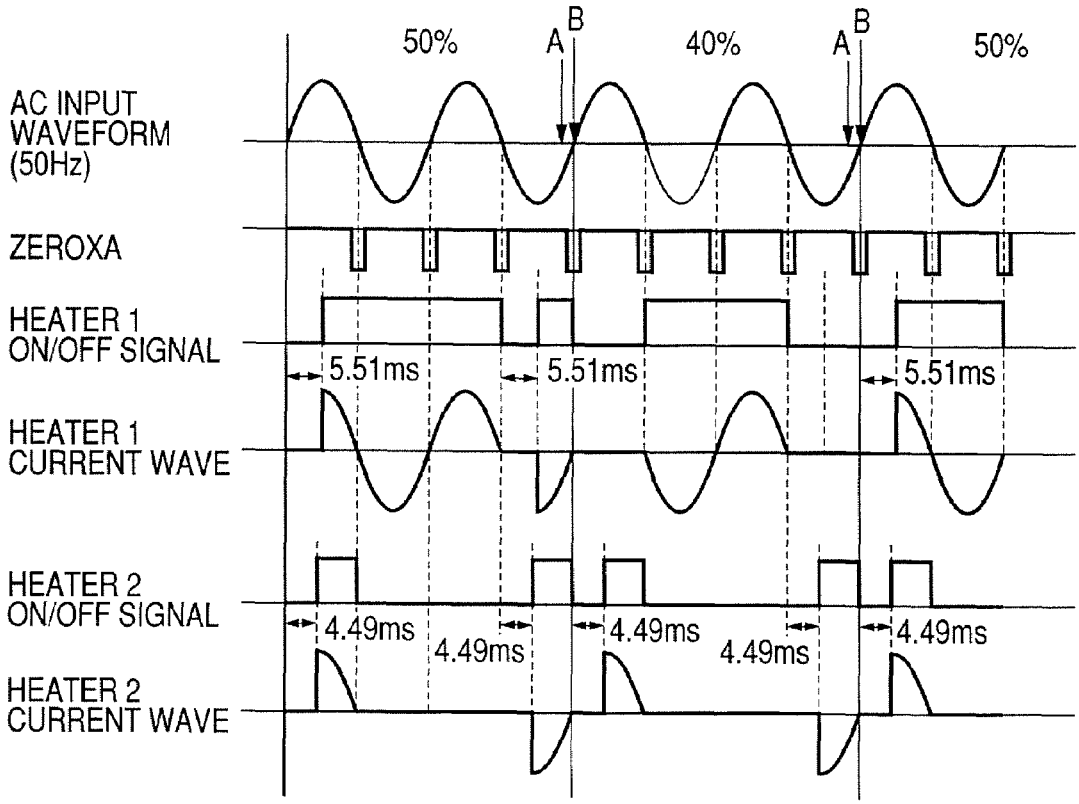
FIG. 13 are waveform charts showing current waveforms corresponding to electric powers of 50% and 40% in FIG. 12.

FIG. 13 shows current waveforms corresponding to electric powers of 50% and 40% in FIG. 12. A temperature detection is executed at a point A in FIG. 13. The timing of such temperature detection is determined in consideration of a timing when the positive side (half-wave) of the AC power can be turned on by 100% after the temperature detection. An output pattern is determined by a PID control according to the detected temperature, and a signal is outputted to turn on the triac thereby executing an on/off control of the heater. The output pattern is changed at a point B shown in FIG. 13. FIG. 13 shows an example of the current waveforms in the heating members 403, 404 where the electric power to the heaters is changed as 50%→40%→50% according to the heater temperature. When the heater power is selected as 50% based on the temperature at the point A, a turn-on timing signal is determined from a zero-cross signal based on the table shown in FIG. 12, and an on/off signal is supplied to the heater driving circuit. A similar control is executed at 40% or another electric power level, thereby achieving a temperature control to maintain a constant temperature.

In this manner there can be provided an image forming apparatus capable of achieving same electric power consumptions at the positive and negative sides of the AC power source, thereby contributing to a sample electric power supply.

The objects of the present invention can naturally be attained also by supplying a system or an apparatus with a memory medium (or recording medium) storing program codes of a software realizing the functions of the aforementioned embodiments, and reading and executing, by a computer (or a CPU or an MPU) of such system or apparatus, the program codes stored in the memory medium.

In such case, the program codes read from the memory medium realize the functions of the aforementioned embodiments, and the memory medium storing the program codes constitutes the present invention.

The present invention naturally includes not only a case where the computer executes the read program codes to realize the functions of the aforementioned embodiments, but also a case where an operating system (OS) or the like functioning on the computer executes all the actual process or a part thereof according to the instructions of the program codes, thereby the functions of the aforementioned embodiments.

The present invention further includes a case where the program codes read from the memory medium are written into a memory provided in a function expansion card inserted in the computer or a function expansion board connected to the computer, and a CPU or the like provided in such function expansion card of function expansion board executes all the actual processes or a part thereof according to the instructions of the program codes, thereby realizing the functions of the aforementioned embodiments, The program may have any form capable of realizing the functions of the aforementioned embodiments by a computer, and assume a form of object codes, a program executed by an interpreter, or script data supplied to the OS.

The recording medium for supplying the program can be any medium capable of storing the program, such as a floppy (trade name) disk, an optical disk, a magnetooptical disk, a CD-ROM, an MO, a CD-R, a CD-RW, a DVD (DVD-ROM, DVD-RAM, DVD−RW or DVD+RW), a magnetic tape, a non-volatile memory card or a ROM. Otherwise, the program may be supplied by a downloading from another computer or a database connected to an internet, a commercial network, or a local area network.

The present invention is not limited to the above embodiments, and various changes and modifications can be made thereto within the spirit and scope of the present invention. Therefore, to apprise the public of the scope of the present invention, the following claims are made.

This application claims priority from Japanese Patent Application Nos. 2004-258712 filed Sep. 6, 2004 and 2004-337701 filed on Nov. 22, 2004, which are hereby incorporated by reference herein.

What is claimed is:

1. A fixing apparatus comprising:

a first heating member and a second heating member; and a current control unit which controls a number of waves thereby controlling a first AC current to be supplied to the first heating member and a second AC current to be supplied to the second heating member by a unit of predetermined number of half-waves;

wherein the current control unit controls each of the first AC current and the second AC current in a positive-negative symmetrical pattern by the unit of predetermined number of half waves; and regardless of a duty ratio level of the first heating member and the second heating member, for each instance the duty ratio changes, when the current control unit controls the number of waves by the unit of predetermined number of half-waves so that the second AC current is larger than the first AC current at a first duty ratio level, the current control unit controls the number of waves by the unit of predetermined number of half-waves so that the first AC current is larger than the second AC current at a second duty ratio level when the first AC current next differs from the second AC current.

2. A fixing apparatus according to the claim 1, wherein the current control unit controls the number of waves by the unit of predetermined number of half-waves so that the first AC current is equal to the second AC current in a third duty ratio level between the first duty ratio level and the second duty ratio level.

3. A fixing apparatus comprising:

a first heating member and a second heating member; and a current control unit which controls a number of waves thereby controlling each of a first AC current to be supplied to the first heating member and a second AC current to be supplied to the second heating member in a positive-negative symmetrical pattern by the unit of predetermined number of half waves;

wherein the current control unit controls the number of waves by the unit of predetermined number of half waves so that the first AC current is equal to the second AC current; and regardless of a duty ratio level of the first heating member and the second heating member, for each instance the duty ratio changes, the current control unit controls the number of waves by the unit of predetermined number of half waves so that the second AC current is larger than the first AC current at a first duty ratio level in which the first AC current differs from the second AC current, the current control unit controls the number of waves by the unit of predetermined number of half waves so that the first AC current is larger than the second AC current at a second duty ratio level in which the first AC current differs from the second AC current, and the second duty ratio level differs from the first duty ratio level, and the current control unit controls the number of waves by the unit of predetermined number of half-waves so that the first AC current is equal to the second AC current at a third duty ratio level between the first duty ratio level and the second duty ratio level.

4. A fixing apparatus comprising:

a first heating member and a second heating member; and a current control unit which controls a number of waves thereby controlling a first AC current to be supplied to the first heating member and a second AC current to be supplied to the second heating member by a unit of predetermined number of half-waves;

wherein the current control unit controls each of the first AC current and the second AC current in a positive-negative symmetrical pattern by the unit of predetermined number of half-waves;

regardless of a duty ratio level of the first heating member and the second heating member, for a plurality of instances the duty ratio changes, when the current control unit controls the number of waves by the unit of predetermined number of half-waves so that the second AC current is larger than the first AC current at a first duty ratio level, the current control unit controls the number of waves by the unit of predetermined number of half-waves so that the first AC current is larger than the second AC current at a second duty ratio level when the first AC current next differs from the second AC current; and wherein for at least one instance of duty ratio change, when the current control unit controls the number of waves by the unit of predetermined number of half-waves so that the second AC current is larger than the first AC current at the first duty ratio level, the current control unit controls the number of waves by the unit of predetermined number of half-waves so that the second AC current is still larger than the first AC current when the first AC current next differs from the second AC current.

5. A fixing apparatus according to the claim 4, wherein the current control unit controls the number of waves by the unit of predetermined number of half-waves so that the first AC current is equal to the second AC current at a third duty ratio level between the first duty ratio level and the second duty ratio level.

* * * * *